US005806596A

United States Patent [19]

Hardy et al.

[11] Patent Number: 5,806,596

[45] Date of Patent: Sep. 15, 1998

[54] ONE-TRIP WHIPSTOCK SETTING AND SQUEEZING METHOD

[75] Inventors: Mel Hardy, Spring, Tex.; Brent Henderson, Anchorage, Ak.; Joe Jordan, Conroe, Tex.; David Nims, Anchorage, Ak.; Aurelio Azuara, Sugar Land, Tex.

[73] Assignee: Baker Hughes Incorporated, Houston, Tex.

[21] Appl. No.: 755,841

[22] Filed: Nov. 26, 1996

[51] Int. Cl.[6] ..... E21B 29/06

[52] U.S. Cl. ..... 166/298; 166/117.6; 175/61; 175/81

[58] Field of Search ..... 166/298, 382, 166/117.6, 117.5, 50, 55.1; 175/61, 80, 81, 82

[56] References Cited

U.S. PATENT DOCUMENTS

| | | | |
|---|---|---|---|
| 2,196,517 | 4/1940 | Bolton | 175/81 |
| 2,509,144 | 5/1950 | Grable et al. | 175/81 |
| 3,336,990 | 8/1967 | Warner et al. | 175/82 |
| 3,339,636 | 9/1967 | Frisby | 175/82 |
| 5,109,924 | 5/1992 | Jurgens et al. | 166/117.5 |
| 5,318,132 | 6/1994 | Odorisio | 166/382 |
| 5,437,340 | 8/1995 | Lee et al. | 175/61 |
| 5,445,222 | 8/1995 | Pritchard et al. | 166/298 |

*Primary Examiner*—Hoang C. Dang
*Attorney, Agent, or Firm*—Rosenblatt & Redano P.C.

[57] ABSTRACT

A one-trip assembly that includes the mill or mills for milling a window, the whipstock, the whipstock anchor or packer, and a valving assembly is disclosed which permits running in all the equipment needed for setting and orienting a whipstock and squeezing cement below the whipstock in one trip. Valving is provided which allows for the squeezing to go on after the whipstock packer is set. A feedback technique to determine that the milling assembly been pulled away from the cementing tube is incorporated into the assembly. In one embodiment, upon initiation of milling, pressure differential is used to shift a tube for valve actuation, effectively isolating the squeezed formation from pressures above the whipstock. In another embodiment, the whipstock is shifted to actuate an upper flapper. A second flapper valve is provided, preferably below the whipstock packer, which, responsive to pressure from below, is urged into a closed position. The onset of milling breaks out shear plugs that were installed in the mill nozzles to facilitate the initial squeeze cementing process through a cementing tube. Milling then proceeds in the normal manner.

31 Claims, 14 Drawing Sheets

ONE-TRIP WHIPSTOCK SETTING AND SQUEEZING METHOD

FIELD OF THE INVENTION

The field of this invention relates to whipstocks and techniques for setting them and milling a window in a single trip while, at the same time, facilitating a cement squeeze job of a formation below the whipstock, and the provision of valving to isolate the squeezed formation from pressures from above and below the whipstock.

BACKGROUND OF THE INVENTION

In the past, the technique of locating a whipstock in a wellbore and milling a window in a casing has required several steps. Whipstocks have been used in the oilfield to assist in the formation of lateral openings in the casing, known as windows, so that a lateral bore can be drilled from the surface in an existing wellbore. In the past, a separate trip has been made for the placement of a packer, which has been used to support the whipstock. One technique has been to place and set the packer, followed by a separate trip with an orientation tool to determine the orientation of the keyway in the packer. Having determined that orientation, the base of the whipstock, which is to engage the keyway in the packer, is oriented in such a manner with respect to the whipstock face so that when the whipstock is securely connected to the packer, it will have the appropriate orientation for milling the window.

On some occasions, there may be a need to isolate the formation below the whipstock packer prior to drilling the window and the lateral bore. In the past, this has involved the use of a wireline-set packer in a first trip, followed by doing the squeeze cementing job through the whipstock packer, followed by another trip for orientation purposes, followed by yet another trip to run in the whipstock and milling assembly. More recently, in Jurgens U.S. Pat. No. 5,109,924, a one-trip window milling system has been disclosed. Using the Jurgens technique, the whipstock and mill assembly are run into the well on a single trip.

In prior applications where squeezing cement was required, a flapper valve was used with the whipstock packer, which was spring-biased to be normally closed against pressures coming from the formation that has just been squeezed. However, when cutting a lateral through a window, these types of flapper valves designed to isolate pressure from below the whipstock packer were not helpful if a situation arose where pressure built up in the lateral. If that occurred, the squeezed formation was not positively isolated by a valve responsive to keeping out pressure from above the whipstock.

Accordingly, a method and apparatus have been developed to allow a one-trip system to orient and set the whipstock, while also permitting a squeeze job below the whipstock packer, and further providing for positive valving to isolate the squeezed formation from pressure buildups from above the whipstock, as well as isolating the zone above the whipstock from any pressures developed below the whipstock packer.

SUMMARY OF THE INVENTION

A one-trip assembly that includes the mill or mills for milling a window, the whipstock, the whipstock anchor or packer, and a valving assembly is disclosed which permits running in all the equipment needed for setting and orienting a whipstock and squeezing cement below the whipstock in one trip. Valving is provided which allows for the squeezing to go on after the whipstock packer is set. A feedback technique to determine that the milling assembly been pulled away from the cementing tube is incorporated into the assembly. In one embodiment, upon initiation of milling, pressure differential is used to shift a tube for valve actuation, effectively isolating the squeezed formation from pressures above the whipstock. In another embodiment, the whipstock is shifted to actuate an upper flapper. A second flapper valve is provided, preferably below the whipstock packer, which, responsive to pressure from below, is urged into a closed position. The onset of milling breaks out shear plugs that were installed in the mill nozzles to facilitate the initial squeeze cementing process through a cementing tube. Milling then proceeds in the normal manner.

DETAILED DESCRIPTION OF THE PREFERRED EMBODIMENT

Figure 1A:
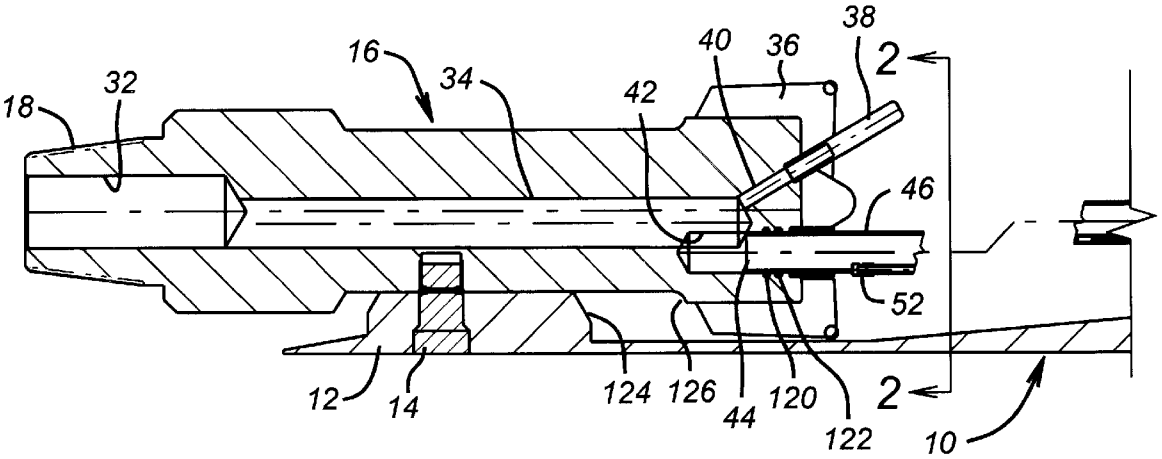
FIGS. 1*a*–1*d* are a sectional elevational view of the assembly, including the whipstock, one of the valves, and a partly schematic rendition of the milling assembly.
Figure 1B:
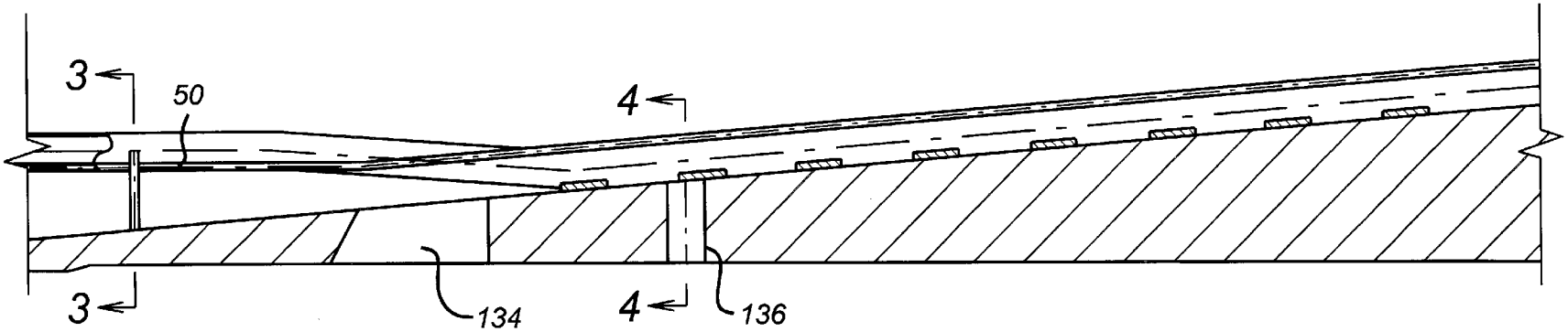

Referring to FIG. 1*a*, the whipstock 10 has a lug 12 through which extends a shear bolt 14. Shear bolt 14 secures the mill assembly 16 to the whipstock 10. In the preferred embodiment, the mill assembly is similar to that disclosed in Jurgens U.S. Pat. No. 5,109,124 with a few differences. The representation in FIG. 1*a* is intended to be schematic as to the mill assembly 16, recognizing that a variety of different mills or assembly of mills can be used to cut a window in a casing (not shown) without departing from the spirit of the invention. Illustrated at the top end of the mill assembly 16 is a thread 18. Thread 18 is also intended to schematically represent the possibility for attachment of various orientation tools of the type known in the art. These tools facilitate transmission of signals to the surface to indicate the orientation of the whipstock face 20 (see FIG. 4) so that a window can be properly oriented in the casing. Generally speaking, coiled or rigid tubing (not shown) is attached to the assembly above the mill assembly 16 at thread 18 for proper positioning of the entire assembly shown in FIGS. 1 and 6 in the wellbore. Those skilled in the art will appreciate that the equipment illustrated in FIGS. 6*a*–6*e*, which comprises a setting tool 22 and a packer 24, are all run in the wellbore together with the whipstock 10 and the mill assembly 16. At the bottom end of the packer 24 is a flapper valve 26, which is biased by a spring 28 into the closed position in response to pressure developed from below it coming up from lower end 30.

Figure 3:
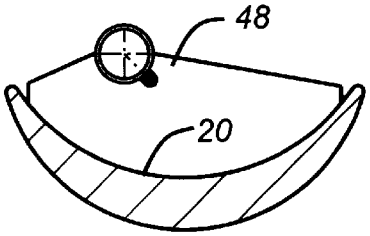
FIG. 3 is the view along lines 3—3 of FIG. 1*b*.
Figure 2:
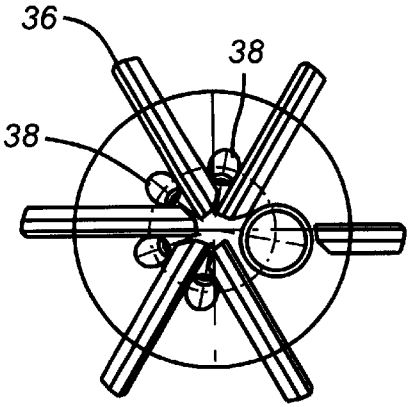
FIG. 2 is the view seen along lines 2—2 of FIG. 1*a*.

The milling assembly 16 has an inlet 32, which is in communication with passage 34 which is eccentrically positioned with respect to inlet 32. The milling assembly 16 has a plurality of blades 36 radiating from its center as can best be seen in FIG. 2. In between the blades for run-in, shear plugs 38 cover passages 40, each of which are in flow communication with passage 34. Also in communication with passage 34 is passage 42, which is disposed eccentrically to passage 34 and accommodates the upper end 44 of cementing tube 46. Cementing tube 46 extends away from the forward face 20 initially, as shown in FIG. 3. A strut or support 48 is used to suspend the cementing tube 46 away from the forward face 20.

Figure 1C:
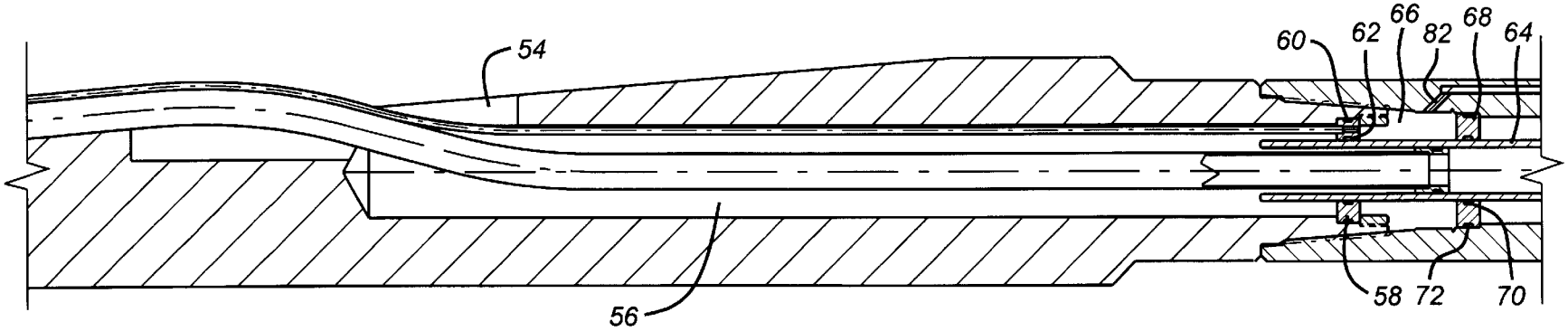
Figure 4:
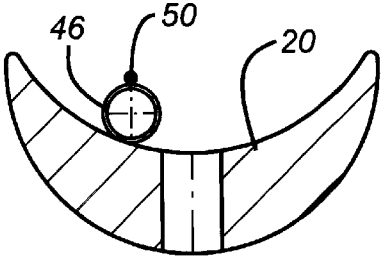
FIG. 4 is the view along lines 4—4 of FIG. 1*b*.

A hydrostatic tube 50 terminates at upper end 52, where it is blanked off for run-in. Tube 50 follows tube 46. By the time they both get down to section 4—4 of FIG. 1, as seen in FIG. 4, both tubes are fully supported by the forward face 20. Referring to FIG. 1*c*, tubes 46 and 50 go through a window 54. Tubes 46 and 50 diverge after passing through window 54 within passage 56. Passage 56 is sealed off by ring 58 working in conjunction with seals 60 and 62. Seal 60 seals against the whipstock 10 and is the outer seal for passage 56. Seal 62 is the inner seal that goes around piston 64 Hydrostatic tube 50 extends through ring 58 and into chamber 66 Chamber 66 is defined additionally by stationary ring 68 working in conjunction with seals 70 and 72. Seal 70 seals against the piston 64 while seal 72 seals against piston sub 74. The piston 64 is movably mounted in the piston sub 74 and is sealed by seal 76. Piston 64 is initially held in the position shown in FIG. 1*c* by a shear pin 77, which extends into groove 78.

Collectively seals 70, 72, and 76 define a chamber 80, which initially is under atmospheric pressure when the equipment, illustrated in FIG. 1, is assembled at the surface. Chamber 66 is also at atmospheric pressure during surface assembly in that the upper end 52 of hydrostatic tube 50 is sealed at the surface and the chamber 66 is also defined by seals 70 and 72 in ring 68. Chamber 66 has a jumper line 82, which is internal to the piston sub 74, and communicates with chamber 84. Chamber 84 is defined by seals 86 and 88 in ring 90, as well as seal 76 on the piston 64. Piston 64 has a hub 92 which supports seal 76 and creates shoulders 94 and 96, which oppose each other. In the run-in position shown in FIG. 1*d*, the piston 64 is a tubular structure which passes through ring 90 and extends to a lower end 98 which holds the flapper 100 in the open position. Flapper 100 is biased by spring 102 to go to a closed position against seat 104 once the lower end 98 is pulled clear of flapper 100, as illustrated in FIG. 7.

Figure 6A:
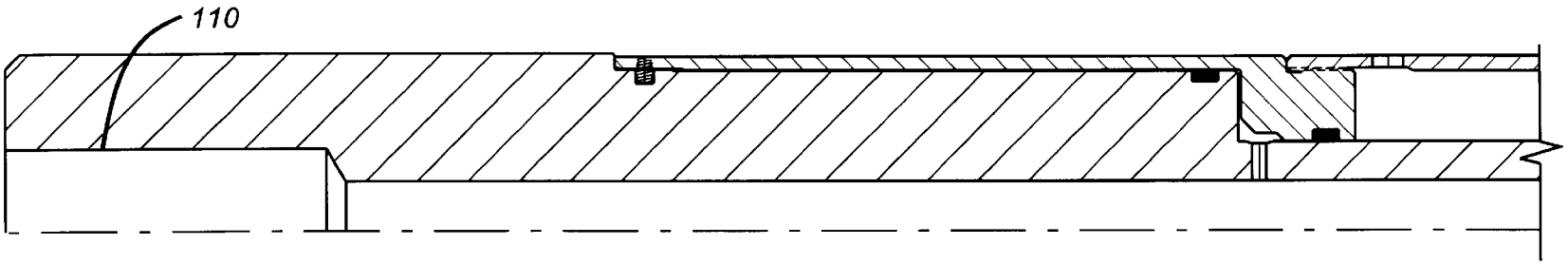
FIGS. 6*a*–6*e* are a sectional elevational view of the setting tool and the whipstock packer, including the lower isolation valve.

The flapper 100 is supported in sub 106, which has a thread 108 at its lower end to accommodate thread 110 of the setting tool 22 (see FIG. 6*a*). The setting tool 22 for the most part is a type well-known in the art. One difference is that the setting tool 22 has a lug 112 which fits into a slot 114 to rotationally lock the setting tool 22 to the packer 24 at bottom sub 116. Located in bottom sub 116 in flow passage 118 is flapper 26, which as stated previously is biased by spring 28 to close from pressures coming from lower end 30.

Figure 7:
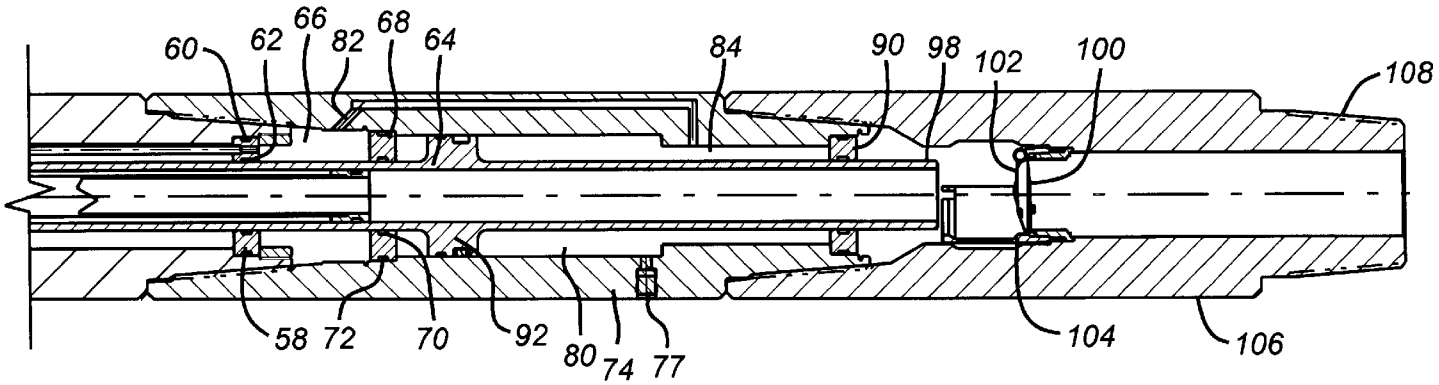
FIG. 7 is similar to the view in FIG. 1*d*, showing the upper isolation valve in the closed position.

Those skilled in the art will appreciate that the orientation of flapper 26 is opposite that of flapper 100 in that flapper 100, once having been allowed to close, as shown in FIG. 7, prevents pressure from tube 46 from getting through the packer 24.

Figure 1D:
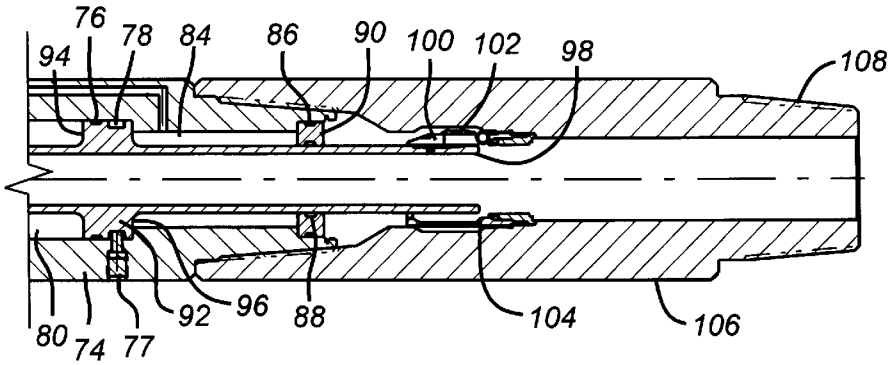
Figure 8:
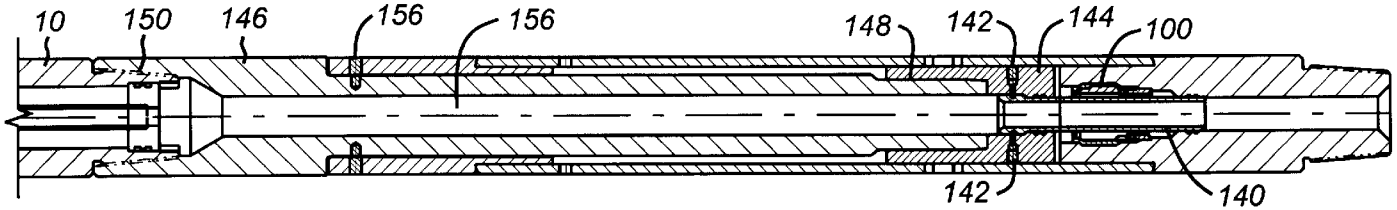
FIG. 8 is a sectional view of an alternative embodiment for actuation of an upper flapper valve in the run-in position.
Figure 9:
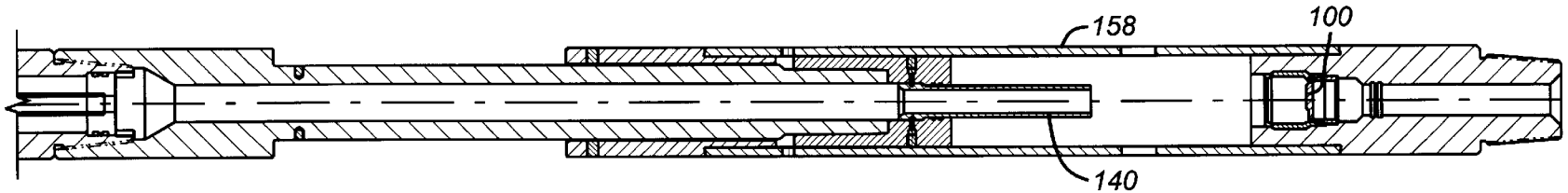
FIG. 9 is the view of FIG. 8 in the flapper closed position.
Figure 10:
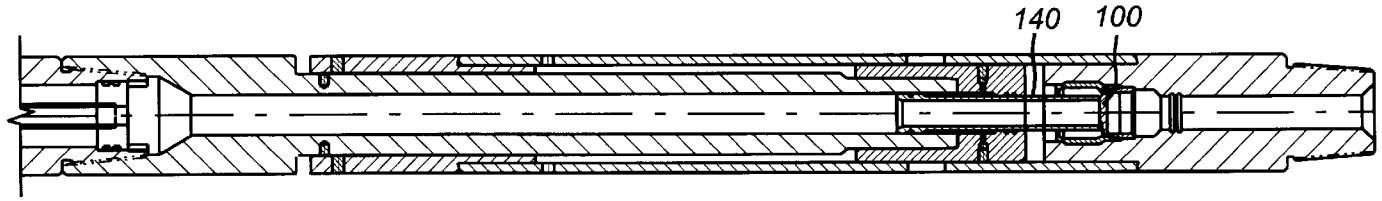
FIG. 10 is the view of FIG. 9 with a sleeve securing the flapper in the closed position.
Figure 11:
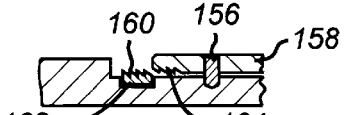
FIG. 11 is a sectional view of a lock assembly to hold the position of FIG. 10.

FIGS. 8–11 illustrate another embodiment for actuation of a flapper, as illustrated in FIG. 1*d*. The same flapper 100 in the assembly shown in FIG. 8 is held open during run-in by a tube 140, which is held in position by shear pins 142. Shear pins 142 extend through bottom nut 144, which is in turn secured to body 146 at thread 148. The whipstock 10 is secured at thread 150 to the body 146. As in the embodiment shown in FIG. 1, the tube 46, this time in isolation without hydrostatic tube 50, extends as shown in FIG. 1 a from upper end 44 and into a seal plate 152. Seals 154 seal around the seal plate 152. Accordingly, the tube 46 allows cement to pass through the seal plate 152, through passage 156 in body 146, and ultimately through the tube 140 on its way past the setting tool 22 and the packer 24 for the squeeze cementing job which occurs below flapper 26, which is at that time held in the open position. In the run-in position shown in FIG. 8, the tube 140 holds open the flapper 100. As previously stated, flapper 100 keeps pressure, from a lateral after the window is milled, from going past it into the recently squeezed portion of the wellbore in the main bore.

In the embodiment of FIGS. 8–11, after the entire assembly is run-in and the packer 24 is set, the cement squeezing occurs through the whipstock 10, through the tube 46, through passage 156, followed by tube 140, and then through the setting tool 22, through the packer 24 and the flapper 26. At the conclusion of the cementing, it is desirable to close the flapper 100. This is accomplished by a pickup force at the surface lifting the whipstock 10, and along with it, the mill assembly 16.

Since the whipstock 10 is connected to the body 146 at thread 150, an upward force on body 146 results in breakage of shear pins 156, causing the body 146 to pull away from the housing 158, which at that time is securely fastened to the packer 24, which has already been set. As seen by comparing FIGS. 8 and 9, the body 146 comes up, lifting the tube 140 away from flapper 100, which is spring-biased to the closed position shown in FIG. 9. Subsequently, as seen by comparing FIGS. 9 and 10, setdown weight is applied at the surface, lowering the whipstock 10 and mill assembly 16 in tandem, such that the tube 140 comes to rest above the closed flapper 100 to secure it further in the closed position. The position of the components illustrated in FIG. 10 can then be locked in through the use of a locking arrangement shown in FIG. 11.

Once the shear pins 156 are broken and the setdown weight is applied after the flapper 100 closes, the teeth 160 unlock ring 162, which is supported by the body 146, and engage the teeth 164, which are disposed at the upper end of the housing 158. Thus, the preferred embodiment illustrated in FIGS. 8–11 presents a simpler construction with fewer seals than the alternative embodiment, which is illustrated at the lower end of the whipstock 10, as seen at the bottom of FIG. 1*c* and in FIG. 1*d*. The end result is the same function, which is to actuate the upper flapper 100 to a closed position at the conclusion of the cementing to ensure that pressure that has built up in any laterals does not get past the packer 24.

The body 146 can have a hexagonal cross-section which mates with a similar profile in housing 158 so that the body 146 is rotationally locked to the housing 158. Once the packer 24 is set through the rotational lock between the housing 158 and the body 146, the whipstock 10 is also locked in a fixed orientation for the milling of the window using the milling assembly 16. In all other respects, the operation of the preferred embodiment illustrated in FIGS. 8–11 is the same as previously described, using the hydrostatic tube 50. Prior to milling, the milling assembly 16 is raised to clear the end of tube 46 from the milling assembly, facilitating the giving of a signal at the surface that tube 46 is out of the milling assembly 16. The milling assembly 16 is then actuated for initiation of the window for the lateral.

The essential elements of several embodiments of the one-trip system having been described, its operation, using the equipment shown in FIGS. 1*c*–1*d*, will now be reviewed in more detail. The assembly illustrated in FIGS. 1*a*–1*d* and 6*a*–6*e* is assembled at the surface and positioned at the appropriate depth. As previously stated, the illustration of the mill assembly 16 is schematic and is intended to include therein, as attached to thread 18, an orientation system of a type well-known in the art, so that surface personnel can determine the exact orientation of the forward face 20 at the desired depth.

FIG. 1*a* illustrates that the upper end 44 of tube 46 is sealed by O-ring seals 120 and 122, which are mounted in passage 42. Additionally, lug 12 has a shoulder 124 which engages shoulder 126 when the shear bolt 14 is broken, as can best be seen by comparing FIG. 1*a* to FIG. 5.

Figure 6B:
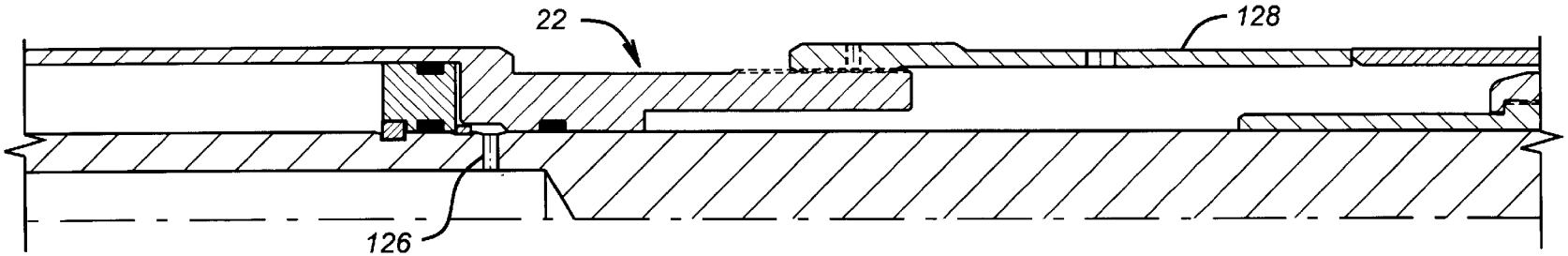

When the assembly shown in FIGS. 1 and 6 is run to the proper depth and the orientation is determined to be correct, the packer 24 is set using the setting tool 22 which operates in a known manner responsive to a pressure buildup through passage 126 (see FIG. 6*b*). This can be accomplished in a number of ways, including dropping a ball which can later be blown through to facilitate the squeeze cementing. Generally, the ball seat is slightly below the passage 126 to allow the downward movement of sleeve 128 to set the packer by moving sleeve 130 on the packer 24. Once the packer is set, the cementing can begin through the passage 32 from the surface through cement tube 46 which can be, for example, a piece of one and one-quarter inch (1¼") coiled tubing.

Figure 6C:
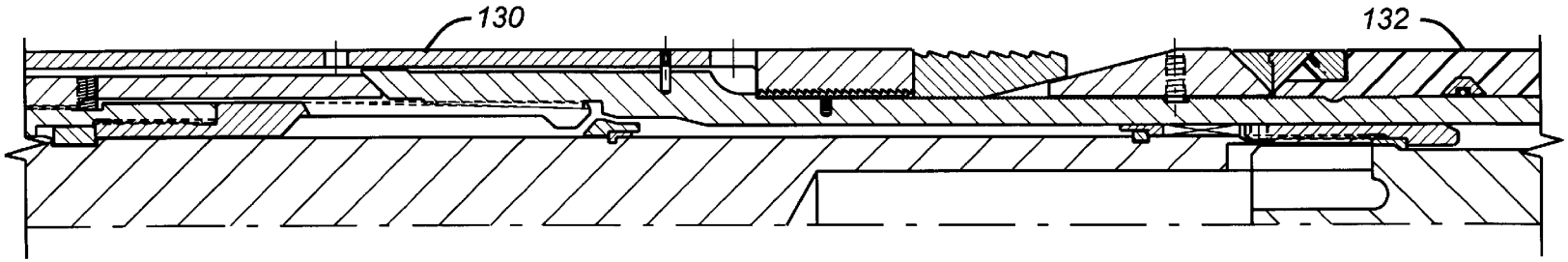
Figure 6D:
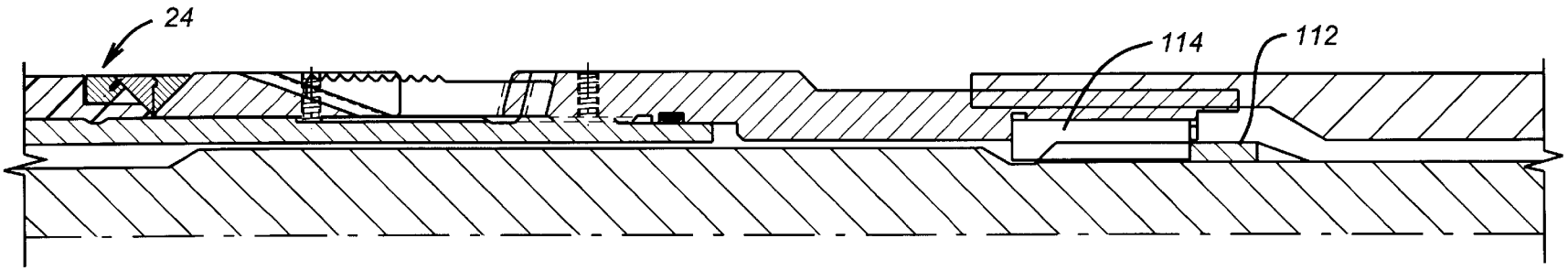
Figure 6E:
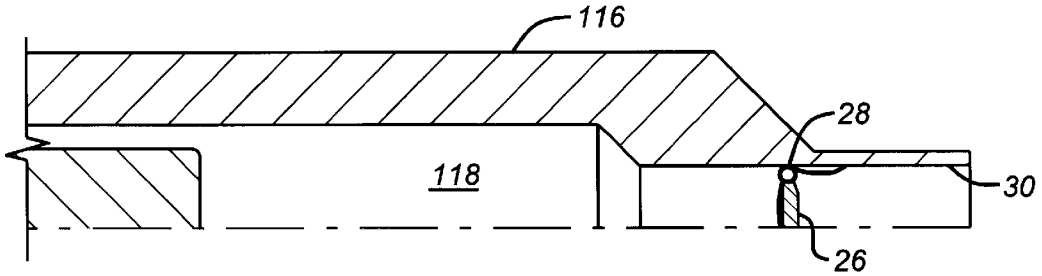

The use of large-diameter tubing for tube 46 facilitates the squeeze cementing without incurring unusually high pressure drops. This is a feature not available in prior designs that use jumper tubes in small diameter to go into or around the whipstock, such as 10, for the purpose of actuating a packer below the whipstock. In the present invention, a large bore passage is available in tube 46 which extends on through the setting tool 22 and the packer 24. At the time the squeeze cementing operation is accomplished, the packer element 132 is fully set, as shown in FIGS. 6*c* and 6*d*. The flapper 100 is being held open by the lower end 98 of piston 64 The flapper 26 is pushed to the open position by the pressure of the cement being pumped from the surface. At the conclusion of the squeeze cementing job, the removal of pressure from the surface allows spring 28 to close flapper 26. Thereafter, surface personnel pick up the string at the surface, which raises the mill assembly 16 sufficiently to break the shear bolt 14.

Figure 5:
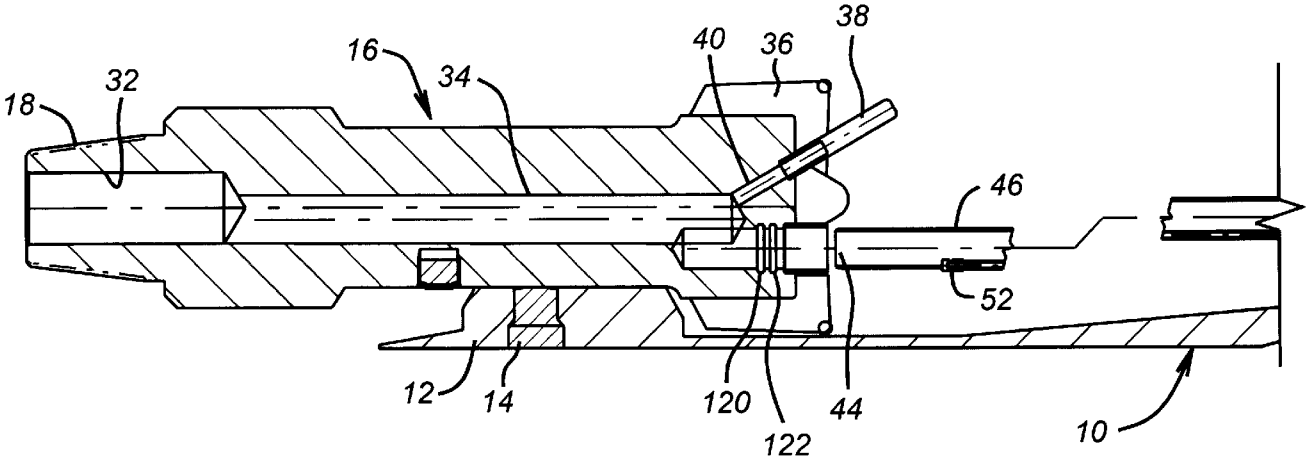
FIG. 5 is the view of FIG. 1*a* with the cementing tube removed.

As seen by comparing FIG. 1*a* with FIG. 5, the upper end 44 of tube 46 is pulled clear of seals 120 and 122. Since the whipstock 10 is potentially thousands of feet below the surface, it is difficult to get physical confirmation that the shear bolt 14 has been severed simply by an upward pull from the surface. It is important to sever shear bolt 14 before rotation of the mill assembly 16. This is because the whipstock 10 is thinnest near its top end where lug 12 retains the milling assembly 16. Any attempt to rotate while shear bolt 14 is still intact could result in twisting or warping of the whipstock 10 and potential hanging up of the mill assembly 16. Accordingly, a feedback mechanism is provided by virtue of the initial space between shoulders 124 and 126. When those two shoulders are pulled into contact, as shown in FIG. 5, circulation from the surface can be established through inlet 32 and ultimately out of the mill assembly 16 through passage 42 and back to the surface. Since tube 46 has separated from passage 42 due to the upward pull, which severed the shear bolt 14 and joined shoulders 124 and 126, surface personnel know that the shear bolt 14 has been severed when they are able to establish circulation. If shear bolt 14 has not been severed, and tube 46 is still sealingly disposed in passage 42 due to seals 120 and 122, application of pressure from the surface merely results in pressure buildup, which is a signal to the surface personnel that the shear bolt 14 has yet to break.

As previously stated, the squeezing of the formation below the packer 24 occurs through the tube 46. The presence of shear plugs 38 directs all the cement through passage 32 out through passage 42 and through the tube 46. The flow continues through the piston 64 which is holding flapper 100 open. Thereafter, the cement flows through the setting tool 22 and the packer 24. The pressure on the cement from the surface opens flapper 26 against the closing force of spring 28. From that point, the cement exits the lower end 30 and goes into the formation that is to be squeezed with cement. At the conclusion of the cementing, which encompasses subsequent flushes with fluid, the pressure is removed, allowing spring 28 to close flapper 26. A pickup force is applied from the surface, shearing shear bolt 14 and bringing shoulder 126 against shoulder 124. With the feedback signal that shear bolt 14 has been broken delivered to the surface, rotation is commenced from the surface and milling begins, using the milling assembly 16. The onset of milling breaks off the shear plugs 38 to permit circulation through passages 40 so that the cuttings from milling using the milling assembly 16 can be circulated back to the surface for removal.

With the onset of milling using the mill assembly 16, the upper end 44 of tube 46 is ground away. Ultimately, the milling assembly 16 engages the upper end 52 of hydrostatic tube 50 and begins to mill it away. This milling action cuts open the top of hydrostatic tube 52, allowing the hydrostatic pressure in the well at that point to enter into hydrostatic tube 50. That pressure goes through chamber 66 and jumper line 82 into chamber 84. Recognizing that the pressure in chamber 80 remains at atmospheric pressure because of seals 70, 72, and 76, there is a force imbalance on piston 64 as the pressure increases in chamber 84. At some pressure level in chamber 84, the pressure in chamber 84, applied to the shoulder 96, exceeds the opposing force of the pressure in chamber 80 applied to shoulder 94. As a result, upward movement of the piston 64 occurs until its lower end 98 moves up clear of flapper 100. This allows spring 102 to rotate the flapper 100 ninety degrees (90°) until the flapper 100 contacts the seat 104. Now, with flapper 100 closed, any pressure buildup from above the whipstock 10 coming from, for example, the lateral wellbore that is to be drilled through the window to be produced with the milling assembly 16, is effectively stopped by the flapper 100 when in the closed position. In essence, flapper 100, once allowed to close, seals off window 54 and passage 56. Those skilled in the art will appreciate that the use of the tandem valves 100 and 26, which may be of any suitable design, facilitates total isolation of the recently squeezed portion of the wellbore. Thus, any pressure that develops downhole from the packer 24 when the sealing element 132 is set, is effectively prevented from coming uphole due to the sealing element 132 and internally due to the closed flapper 26.

Alternatively, if high pressures develop in a lateral drilled through a window after using the mill assembly 16, it is effectively prevented from communication with the squeezed formation by virtue of flapper 100 being closed, which, in turn, closes off an internal avenue through window 54 and passage 56. Of course, the packer 24 with its element 132 sealing around it in the wellbore will also isolate uphole pressures on the outside of the assembly from reaching the squeezed portion of the formation.

Those skilled in the art will appreciate that the onset of milling by rotation of the mill assembly 16 places loads on the whipstock 10 which are torsional in nature. Another feature of the present invention is the setting tool 22 has a lug 112, which is oriented in a slot 114 for resistance of rotation. Thus, after the setting tool 22 serves its purpose by setting the packer 24, it then becomes a conduit which is rotationally locked to the packer 24. It in turn supports the whipstock 10 against applied torsional loads from the milling operation. Opening 134 in the whipstock 10 is used for retrieval purposes after the conclusion of milling using the milling assembly 116. Opening 136 which is shown in FIG. 4, is offset from the positioning of the tubes 46 and 50, and is used at the surface for temporary support of the whipstock 10 to facilitate the assembly of components.

The main advantages of several alternative embodiments of the apparatus having been described, those skilled in the art can immediately see the advantage of a truly one-trip system that permits the conducting of a squeeze job below a whipstock support packer combined with, in the same trip, being able to position and secure a whipstock and mill a window. An added advantage of the system is that valving is provided such that the squeezed formation is effectively isolated from pressures above the whipstock, while the wellbore itself is valved off internally through the apparatus from any pressures developing below the whipstock packer 24. Thus, if the assembly, as schematically illustrated in FIGS. 1 and 6, is fully assembled and includes, as indicated, an orientation device attached at thread 18, surface personnel can lower the assembly to the required depth and get an orientation on the position of the forward face 20 of the whipstock 10. Once having ascertained that the proper depth has been achieved, as well as the proper orientation, the packer is set using known techniques for pressure buildup. The setting tool 22 remains in place and acts to transmit torque applied to the whipstock 10 down to the whipstock packer 24. The squeeze job is then made possible by the use of large tubing for cement tube 46 in conjunction with plugging up the nozzle openings 40 so that appropriate pressure can be applied to the cement for the squeeze operation without risk of fouling the nozzle openings or passages 40. Additionally, the use of sturdy tubing for the cement tube 46, such as, for example, 1¼" coiled tubing along with proper support, such as 48, assures the integrity of the system during run in.

Another advantage of the system is to get feedback at the surface that the mill assembly 16 has disconnected from the mounting 112 by virtue of shearing the shear bolt 14. Finally, the onset of milling actuates the piston 64 to close the flapper 100 so that the recently squeezed formation is isolated from pressures built up above the whipstock 10, such as, for example, in the new lateral to be drilled through the opening in the casing produced by the mill assembly 16. Thus, what has previously taken two or more trips in the past has now been integrated into a system where numerous functions are accomplished in a single trip. This saves the operator time which translates to substantial economic savings. Additionally, with the time savings, the new lateral to be drilled can be put into production that much faster, also increasing economic benefits to the owner of the well.

While a series of chambers acting on a piston 64 have been illustrated as a mechanism for actuating a flapper 100, different actuation mechanisms and different valve types and designs are considered to be within the purview of the invention. Additionally, the routing of the cement to below the whipstock 10 can also be done in different ways without departing from the spirit of the invention. The setting tool and packer type can be varied, again without departing from the spirit of the invention.

Figure 12A:
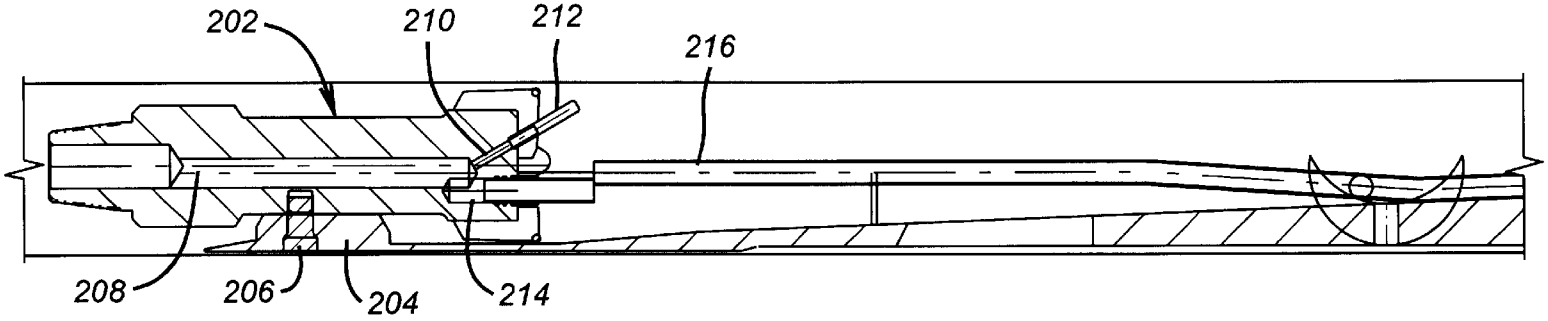
FIGS. 12*a*–*f* are a sectional elevational view of the preferred embodiment of the invention.
Figure 12B:
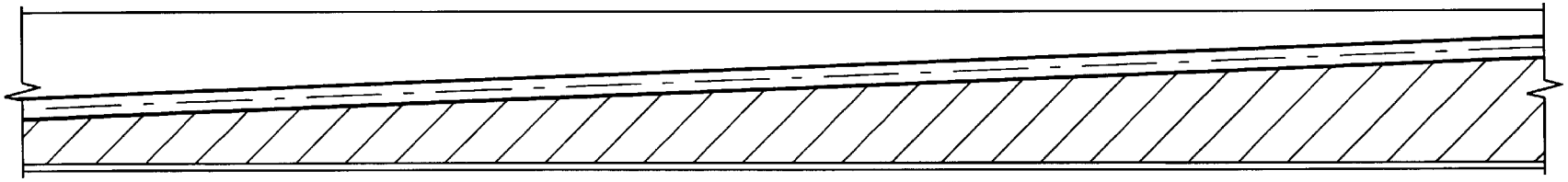
Figure 12C:
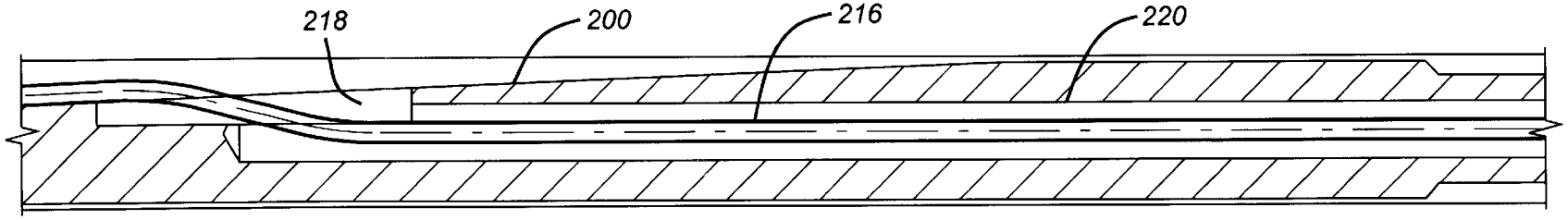
Figure 12D:
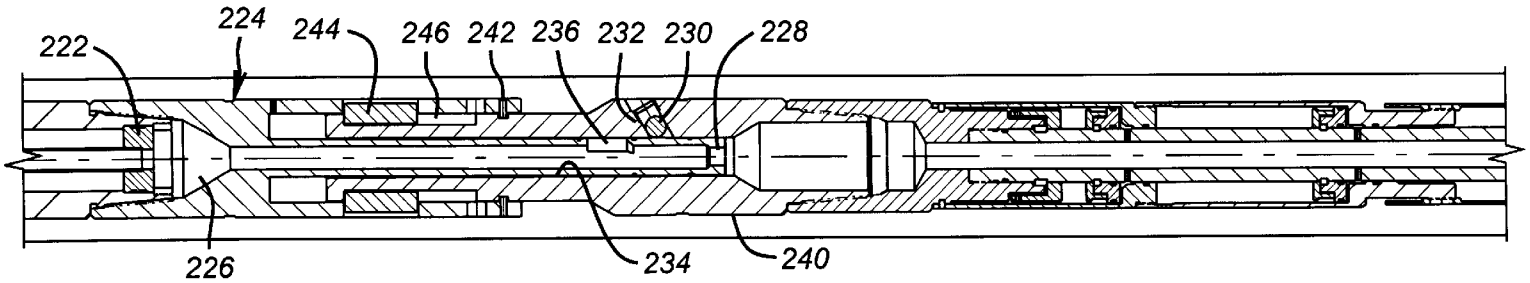

The preferred embodiment of the present invention is illustrated in FIGS. 12*a–f* and FIGS. 13–16. The overall assembly is shown in FIGS. 12*a–f*. A whipstock 200 has a mill assembly 202 connected during run-in to lug 204 by virtue of a shear pin 206 The mill assembly 202 has a central flowpath 208, which communicates with a series of oblique passages 210, which are initially plugged via plugs 212. Plugs 212 are later broken off when the mill is rotated to circulate fluid during milling. An offset passage 214 is in fluid communication with passage 208. A continuous tube 216, which defines a flowpath for subsequent packer 238 setting and cementing below that packer, extends from the mill assembly 202, as shown in FIG. 12*a*, along the whipstock through an opening 218 and through passage 220 in whipstock 200. Tube 216 terminates in seal 222 in upper valve sub 224. Valve sub 224 has a passage 226 which terminates in ball seat 228. A ball 230 is held during run-in in passage 232 by valve sub 224. Valve sub 224 has a tubular segment 234 which during run-in, as shown in FIG. 12*d*, keeps ball 230 in passage 232. The tubular segment 234 has an opening 236 which, when brought into alignment with passage 232, allows ball 230 to escape and seat itself on seat 228, effectively acting as a valve to keep pressures from above the whipstock 200 from either laterals or directly from above the whipstock 200 from passing below the packer 238.

Valve sub 224 has a lower segment 240. Lower segment 240 is attached to valve sub 224 by a shear pin or pins 242. Valve sub 224 is rotationally locked to lower segment 240 by a key or keys 244 which extend into a groove 246. Those skilled in the art will appreciate that when it comes time to close off passage 226, setdown weight is applied to the whipstock 200, breaking shear pins 242 and driving down tubular segment 234 until opening 236 aligns with passage 232, releasing ball 230 to drop onto ball seat 228, effectively closing passage 226 from pressures above the whipstock 200. Other valve types can be used without departing from the spirit of the invention. Actuation by setdown weight is preferred, although other setting techniques are within the scope of the invention.

Figure 12E:
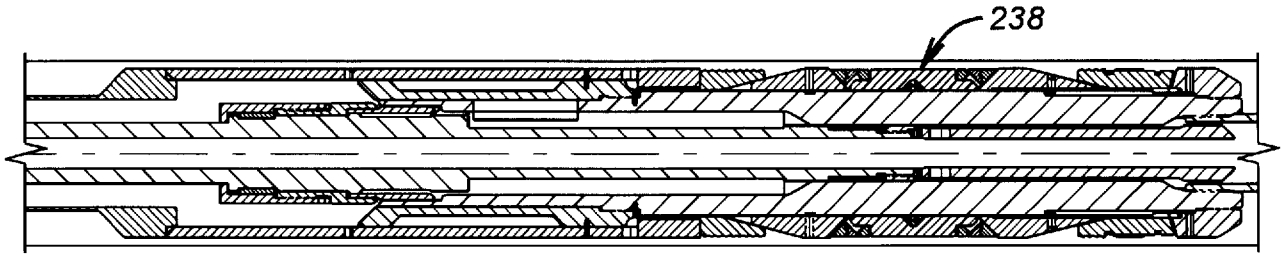
Figure 12F:
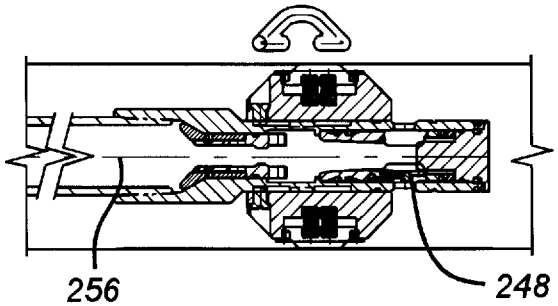

At the lower end of the assembly shown in FIG. 12*f* is a valve 248. Valve 248 is a flapper-type valve preferably, and is of known design. Its purpose is to isolate lower portions of the wellbore subsequent to a cementing operation which takes place through tube 216. At the end of the cementing operation, the valve 248 goes into a closed position, as shown in FIG. 15. FIGS. 13–16 illustrate the lower end of the assembly depicted in FIG. 12*f* in greater detail.

Figure 13:
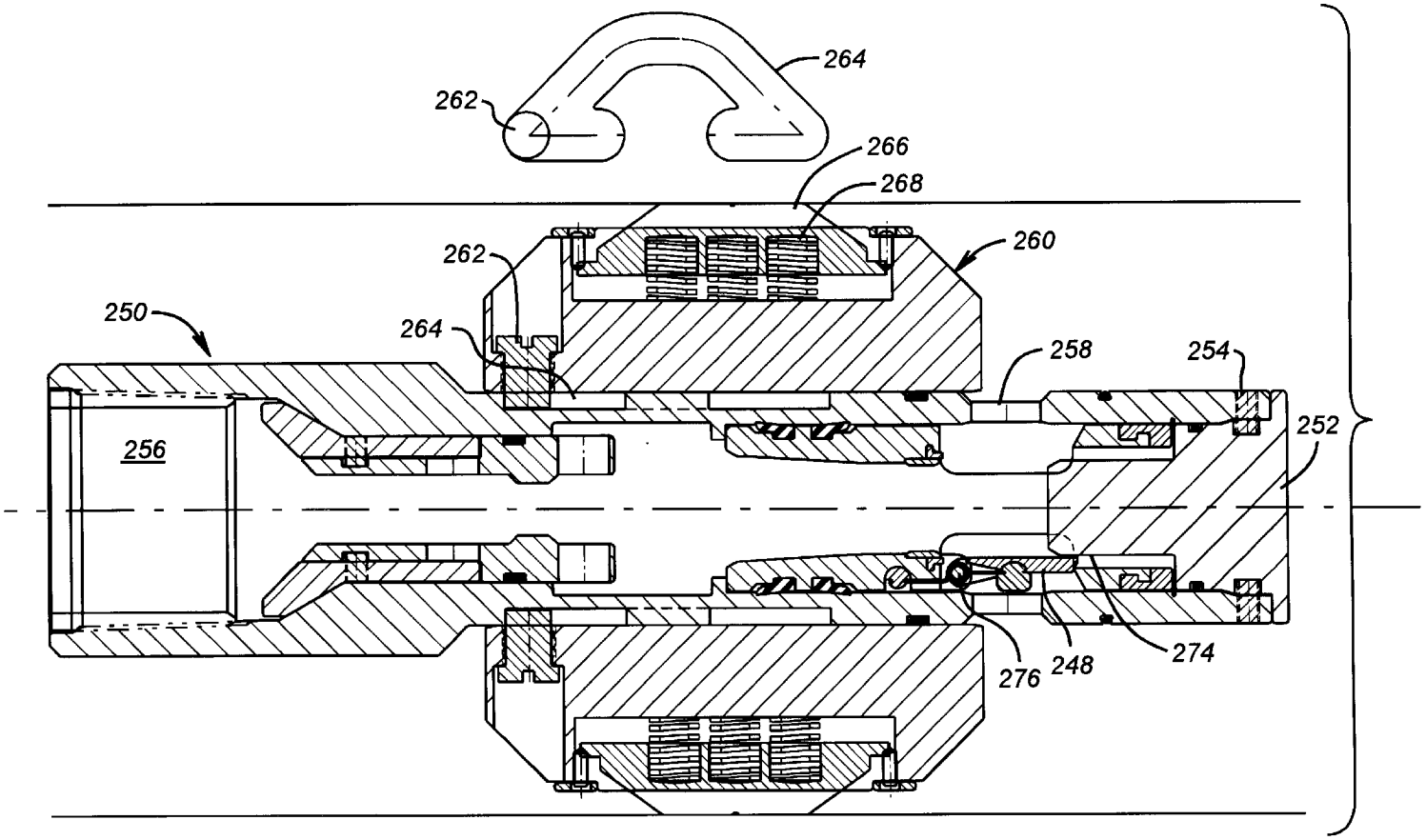
FIG. 13 is a view of the lower valve in the open position, with the flow port open.

What is represented in FIG. 12*e* is a hydraulically set packer 238. FIG. 13 shows a lower valve sub 250, which holds valve 248 shown in the open position. Plug 252 is held to the lower valve sub 250 by pin or pins 254 which, upon application of sufficient pressure to plug 252, will release plug 252 as shown in FIG. 15. Lower valve sub 250 has a central passage 256 which is in fluid communication with the packer 238 for setting the packer. During run-in, the lateral ports 258 are exposed to allow flow through the assembly while it is put into position in the wellbore. A shiftable lug 260 is connected by pin 262 to a J-slot 264 located on the outer surface of lower valve sub 250. The shape of the J-slot 264, with the lug 260 in the open position for port 258, is illustrated immediately in the upper portion of FIG. 13, showing the juxtaposition of pin 262 in the J-slot 264.

Supported by the lug 260 is a friction pad 266 which is outwardly biased by a spring or springs 268. There are multiple lugs 260, each similarly equipped and disposed around the periphery of the lower valve sub 250 to act as centralizers and to retain the lugs 260 while the lower valve sub 250 is being manipulated so that the port or ports 258 can be closed. Port 258 is left open during run-in to allow equalization between the inside and outside of the assembly depicted in FIGS. 12*a–f* during run-in. When the proper depth in the wellbore has been attained, the packer 238 is set.

Figure 14:
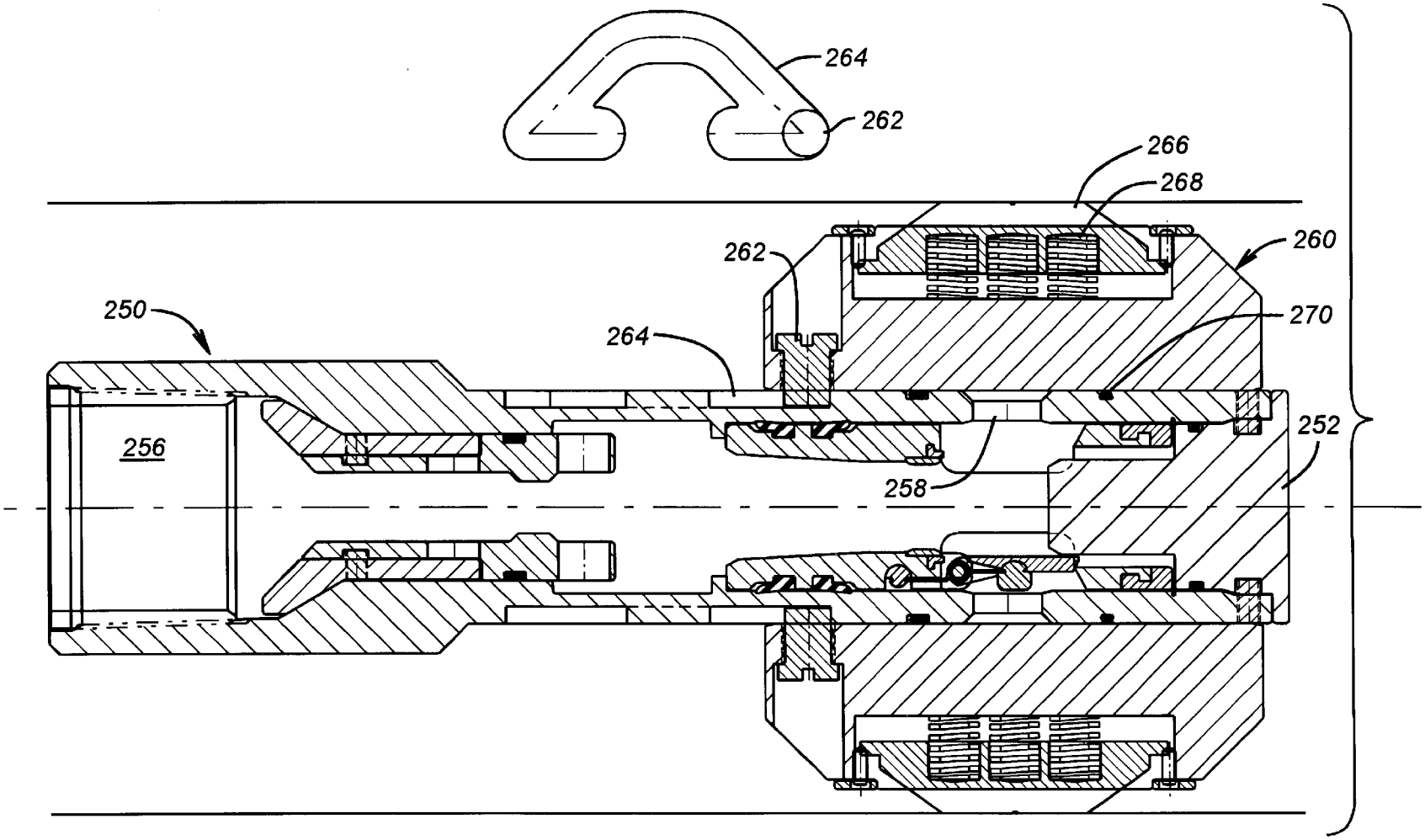
FIG. 14 is the view of FIG. 13 with the flow port closed.
Figure 15:
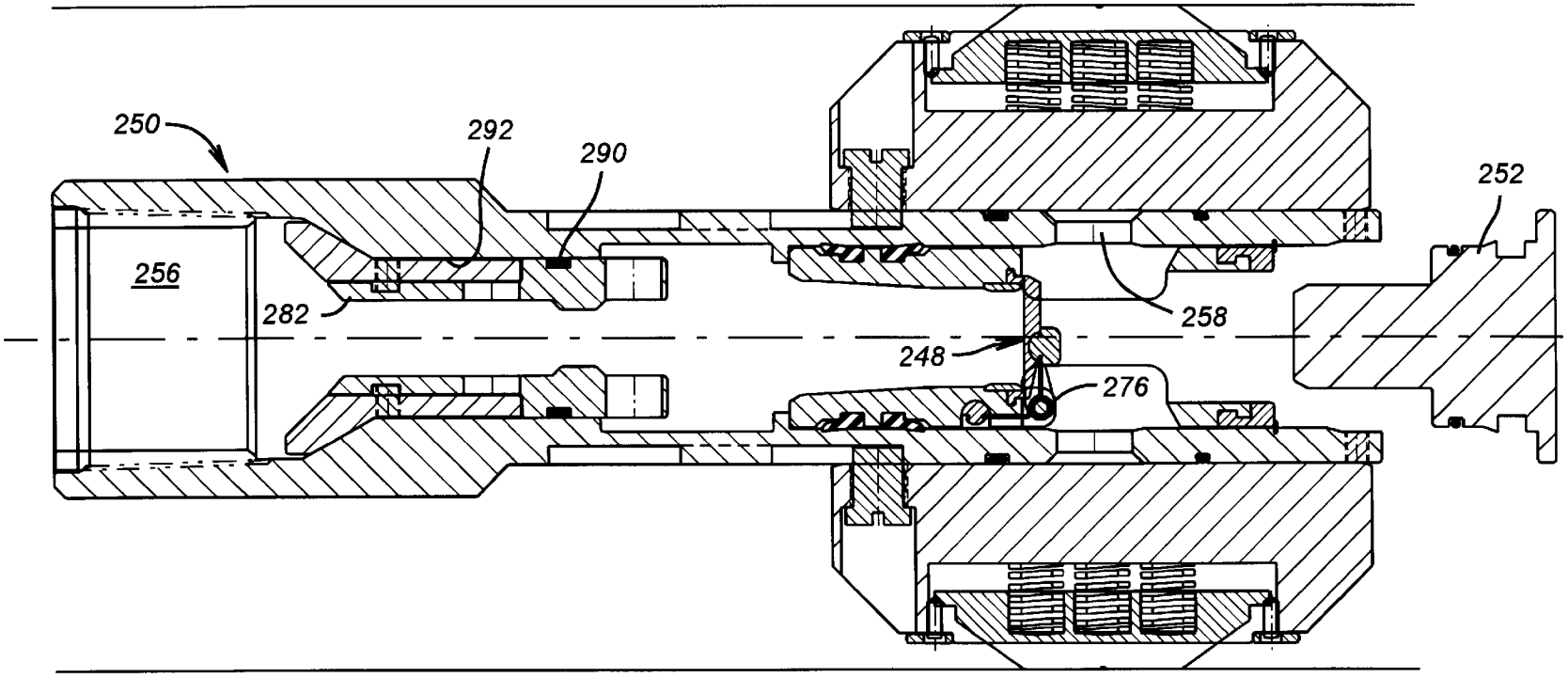
FIG. 15 is the view of FIG. 14, with the lower valve closed.

The procedure for normally setting the packer 238 using hydraulic pressure is to manipulate the lower valve sub 250 from the surface so that the pin 262 is now in the opposite portion of the J-slot 264, as depicted in the upper portion of FIG. 14. As seen by comparing FIGS. 13 and 14, the lugs 260 have shifted downwardly so that they span opening 258 and sealingly close it off by virtue of seals 270 and 272. At this point, pressure is built up in passage 256 which, as shown in FIG. 14, is still obstructed at its lower end by plug 252. Sufficient pressure can build up to set the packer 238 without blowing out the plug 252. Eventually, further pressure is developed in passage 256 to blow out plug 252, as shown in FIG. 15. At this time, cement can be pumped through tube 216 to passage 256 and through valve 248, which is displaced into the open position from the cement being pumped from above. At the conclusion of the cementing operation, as a wiper passes through valve 248, the valve is able to reach a closed position, shown in FIG. 15, to preclude pressures from the recently cemented portion of the formation from passing uphole to whipstock 200. It should be noted that plug 252 has an extension segment 274 which, during run-in, spans over valve 248 and holds it in the open position against the force of spring 276. Once the plug 252 is pushed out, as shown in FIG. 15, the spring 276 turns the valve 248 90° into the closed position. The valve can then be pushed open by pumped cement, and thereafter, due to bottom-hole pressures and the force of spring 276, valve 248 precludes uphole flow from the cemented formation up to the whipstock 200.

Figure 16:
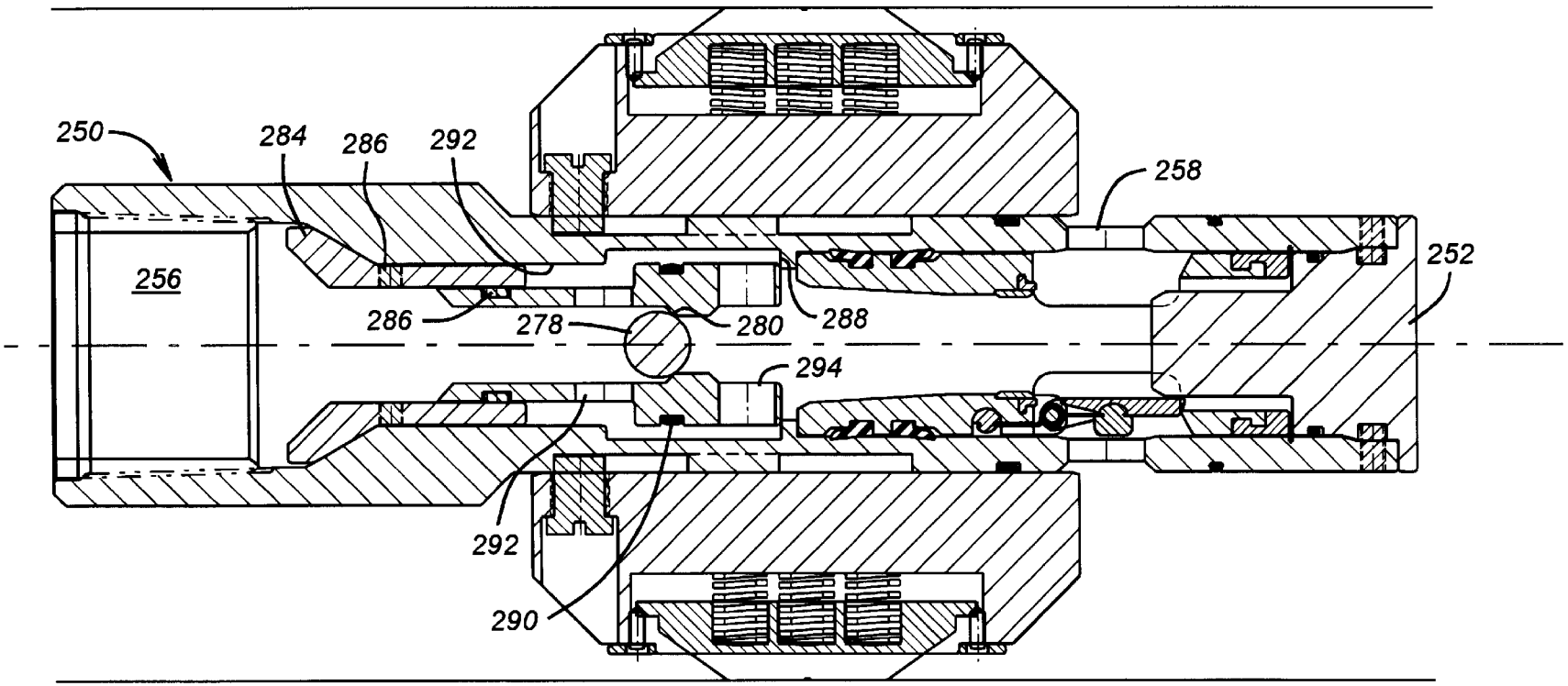
FIG. 16 illustrates an alternative technique for setting the packer if, for any reason, the flow port cannot be closed off, as shown in FIG. 14.

FIG. 16 illustrates an alternative technique if, for any reason, passage 258 cannot be closed off by manipulation of lower valve sub 250 from the surface, in combination with pin 262 interacting with J-slot 264. Should that occur for any reason, and pressure build-up cannot be obtained at the surface because port 258 cannot be fully closed, a ball 278 is dropped from the surface to catch on seat 280. When the ball 278 is seated on seat 280, pressure can be built up in passage 256, despite the fact that passage 258 cannot be closed. The ball seat 280 is part of a tubular member 282, which is initially pinned to sleeve 284. Thus, the packer 238 can be set when the pressure to a predetermined level is built up on ball 278. However, the shear pin 286 does not break until a higher pressure is reached. By the time that shear pin 286 breaks, the packer 238 has already been set and the tubular member 282 is shifted until it bottoms on shoulder 288, which is internal to lower valve sub 250. As seen by comparing FIGS. 15 and 16, seal 290, which seals between the tubular member 282 and the lower valve sub 250 in passage 256, eventually moves away from sealing surface 292. The cementing operation can then begin. The pressurization from the cement flowing around ball 278 through ports 292, then ports 294, will also displace the plug 252, even though some cement may escape through passage 258 which has not completely closed.

The preferred embodiment, shown in FIGS. 12–16, illustrates an assembly which allows for closure of a recently cemented segment of a wellbore below a whipstock against pressures coming uphole toward the whipstock by virtue of valve 248. At the same time, the assembly provides a technique for closure of the remainder of the wellbore above the whipstock 200 from the recently cemented portions of the whipstock below the packer 238. The ball 230, in combination with seat 228, accomplishes this purpose. Once the cementing procedure as described is concluded, the mill assembly 202 is picked up to shear shear pin 206 and to pull out tube 216 from passage 214. The pulling out of tube 216 from passage 214 will be seen as a pressure loss signal at the surface, telling surface personnel that the tube 216 is now clear of the mill assembly 202. Milling the window can then begin.

Thus, in a single trip, the whipstock 200 can be located at the desired depth with a packer 238, and properly oriented, if required, using known orientation equipment. The orientation equipment can be part of the string lowered in the single trip. Alternatively, markers which may be in the wellbore from previous operations can be used for orientation of the whipstock 200. Yet other known orientation techniques can be used. In some applications, the whipstock orientation may not be important and no orientation equipment or techniques are needed.

Again, the representation of the mill assembly 202 is intended to incorporate known orientation tools and/or other known depth-sensing tools, if needed, as part of the string. Typically, this equipment would be mounted above the mill itself, shown in FIG. 12*a*. One of the advantages is the mode of actuation of the upper valve which comprises the ball 230 and the seat 228 by a setdown weight. Using setdown weight gives greater assurances of actuation than a pickup or a twisting force because of the uncertainties of expansion downhole, particularly when using coiled tubing. With a setdown weight, greater assurances of closing the upper valve with ball 230 is obtained. A pressure test can be conducted from the surface through tube 216 before it is separated from the mill assembly 202 to determine that ball 230 has seated on seat 228. Once that has been determined from a pressure test from the surface, the pickup force on the mill assembly 202 is applied to separate tube 216 from the mill assembly 202 to allow for the onset of milling of the window.

The mechanism shown in FIGS. 13–15 allows a normal technique for packer setting and a backup technique involving the dropping of a ball 278 in the event the port 258 cannot be closed off by lug 260. At the conclusion of the one-trip whipstock setting and cementing process, the whipstock 200 is in the proper location, supported by a set packer 238, and properly oriented for milling of the window. Two valves are closed off, isolating pressures from below the packer 238 from coming uphole through the packer, and isolating pressures from above the whipstock 200 from coming through the whipstock 200 past the packer 238. Without making additional trips into the well, milling the window can proceed in a single trip.

The foregoing disclosure and description of the invention are illustrative and explanatory thereof, and various changes in the size, shape and materials, as well as in the details of the illustrated construction, may be made without departing from the spirit of the invention.

We claim:

1. A method of milling downhole, comprising:

connecting a flowpath from at least one mill through a whipstock to a packer which can support the whipstock;

running in said connected components in a single trip;

setting said packer to support said whipstock;

squeezing the formation below said packer with a sealing material flowing through said flowpath which extends through said packer; and milling downhole with said mill in conjunction with said whipstock in said single trip.

2. A method of milling downhole, comprising:

connecting a flowpath from at least one mill through a whipstock to a support for the whipstock;

providing at least one valve member in said flowpath;

running in said connected components in a single trip;

setting said support;

flowing sealing material through said mill;

squeezing the formation below said support with said sealing material flowing through said flowpath which extends through said support;

isolating said flowpath after said squeezing;

milling downhole with said mill in conjunction with said whipstock in said single trip.

3. The method of claim 2, further comprising:

blocking mill nozzles initially to facilitate flow of sealing material through said mill.

4. The method of claim 3, further comprising:

providing a conduit from an opening in said mill to beyond said whipstock to serve as said flowpath for direction of said sealing material under pressure to the formation beyond said support.

5. The method of claim 4, further comprising:

applying a longitudinal force to said mill after setting said support;

breaking a temporary support between said mill and said whipstock;

removing an end of said conduit from said mill as a result of said force;

using a pressure change sensed at the surface due to said removal of said end as a signal that said temporary support has broken.

6. The method of claim 5, further comprising:

rotating said mill after sensing said pressure change;

actuating a valve in said conduit due to said rotation.

7. The method of claim 2, further comprising:

closing said valve in said flowpath after said squeezing.

8. The method of claim 7, further comprising:

providing a piston having a bore therethrough as part of said passage;

shifting said piston to operate said valve in said flowpath.

9. The method of claim 8, further comprising:

using said piston to hold open said valve to facilitate said squeezing;

creating a force imbalance after said squeezing sufficient to move said piston to allow said valve to close.

10. The method of claim 9, further comprising:

using rotation of said mill to create said force imbalance on said piston.

11. The method of claim 10, further comprising:

providing chambers on opposed sides of a shoulder on said piston;

trapping a low pressure in both of said chambers during run-in;

allowing pressure to build up in one of said chambers due to rotation of said mill;

using said pressure imbalance to move said piston.

12. The method of claim 11, further comprising:

running a hydrostatic line from one of said chambers to a position accessible to said mill;

initially capping said hydrostatic line during run-in to avoid pressure buildup in the chamber to which it is connected;

rotating said mill to cut said capped end of said hydrostatic line;

allowing pressure to rise in one of said chambers due to said cutting of said capped end.

13. A method of milling downhole, comprising:

connecting a flowpath from at least one mill through a whipstock to a support for the whipstock;

providing at least an upper and a lower valve in said flowpath;

running in said connected components in a single trip;

setting said support;

squeezing the formation below said support with a sealing material flowing through said flowpath which extends through said support;

milling downhole with said mill in conjunction with said whipstock in said single trip.

14. The method of claim 13, further comprising:

orienting said lower valve to block flow from said squeezed formation uphole through said support and to the surface;

orienting said upper valve to block flow in a downhole direction from above said whipstock.

15. The method of claim 14, further comprising:

allowing said upper valve to close by manipulation of said whipstock from the surface.

16. The method of claim 15, further comprising:

lifting a sleeve holding said upper valve open by virtue of uphole movement of said whipstock.

17. The method of claim 16, further comprising:

biasing said upper valve to close when said sleeve is shifted clear of it;

lowering said sleeve to contact said upper valve to secure it in a closed position.

18. The method of claim 17, further comprising:

locking said sleeve when in contact with said upper valve, with said upper valve in said closed position.

19. The method of claim 17, further comprising:

moving said mill uphole relative to said whipstock;

pulling an end of a conduit, which serves as at least a portion of said flowpath, out of said mill, said conduit prior to said pulling extending from said mill beyond said whipstock for direction of sealing material to the formation beyond said support;

using a pressure change sensed at the surface due to said removal of said end as a signal that said end of said conduit is out of said mill.

20. The method of claim 19, further comprising:

rotating said mill after sensing said pressure change.

21. The method of claim 15, further comprising:

providing an upper valve sub which holds said upper valve;

providing a seat in said upper valve sub;

allowing a plug to reach the seat responsive to said manipulation of said whipstock from the surface.

22. The method of claim 21, further comprising:

storing said plug outside of said flowpath extending through said upper valve sub;

moving a portion of said upper valve sub with respect to another portion thereof responsive to said whipstock manipulation from the surface;

allowing said plug to enter said flowpath in said upper valve sub as a result of said movement therein.

23. The method of claim 22, further comprising:

trapping said plug in a lateral passage;

isolating said lateral passage from said flowpath extending through said upper valve sub by a movable tube;

orienting a lateral opening in said tube with said lateral passage to allow said plug to enter said flowpath extending through said upper valve sub for contact with said seat.

24. The method of claim 14, further comprising:

providing a lower valve sub to hold said lower valve;

manipulating said lower valve sub from the surface;

closing off said flowpath below said support by said manipulation;

building up pressure in said lower valve sub to set said support.

25. The method of claim 24, further comprising:

providing an elongated passage in said lower valve sub;

providing a lateral opening through said lower valve sub to said elongated passage;

selectively obstructing said lateral opening to facilitate pressurizing said elongated passage and said support to set said support.

26. The method of claim 25, further comprising:

using a removable member to selectively obstruct one end of said elongated passage;

raising pressure in said elongated passage against said removable member;

setting said support at a pressure in said elongated passage which is insufficient to displace said removable member;

raising pressure in said elongated passage;

expelling said removable member to facilitate passage of said sealing material through said end of said elongated passage.

27. The method of claim 26, further comprising:

holding open said lower valve with said removable member;

allowing said lower valve to be closed upon expulsion of said removable member.

28. The method of claim 27, further comprising:

using at least one externally mounted lug on said lower valve sub;

shifting said lower valve sub from the surface;

selectively covering said lateral opening with said lug.

29. The method of claim 28, further comprising:

connecting said lug to said lower valve sub with a pin and slot connection;

providing a biased member on said lug to frictionally engage a casing downhole to facilitate repositioning said lug as said pin is guided by said slot.

30. The method of claim 25, further comprising:

selectively obstructing said elongated passage uphole from said lateral opening as a backup measure if said lateral opening cannot be selectively obstructed.

31. The method of claim 30, further comprising:

dropping a plug from the surface onto a selectively movable seat in said lower valve sub so as to allow pressurization of said support despite an inability to close said lateral opening;

shifting said seat after setting said support;

providing openings for flow of said sealing material around said plug when on said seat as a result of said shifting of said seat.

* * * * *